US009859031B2

(12) United States Patent
Kuwagaki

(10) Patent No.: US 9,859,031 B2
(45) Date of Patent: Jan. 2, 2018

(54) CU—NI—SI BASED COPPER ALLOY

(71) Applicant: JX Nippon Mining & Metals Corporation, Tokyo (JP)

(72) Inventor: Hiroshi Kuwagaki, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 537 days.

(21) Appl. No.: 14/395,887

(22) PCT Filed: Feb. 15, 2013

(86) PCT No.: PCT/JP2013/053681
§ 371 (c)(1),
(2) Date: Oct. 21, 2014

(87) PCT Pub. No.: WO2013/161351
PCT Pub. Date: Oct. 31, 2013

(65) Prior Publication Data

US 2015/0110668 A1 Apr. 23, 2015

(30) Foreign Application Priority Data

Apr. 24, 2012 (JP) ..... 2012-098643

(51) Int. Cl.
*C22C 9/06* (2006.01)
*H01B 1/02* (2006.01)
*C22F 1/08* (2006.01)

(52) U.S. Cl.
CPC ..... *H01B 1/026* (2013.01); *C22C 9/06* (2013.01); *C22F 1/08* (2013.01)

(58) Field of Classification Search
CPC ..... C22C 9/06
See application file for complete search history.

(56) References Cited

U.S. PATENT DOCUMENTS

2005/0236074 A1* 10/2005 Mihara ..... C22C 9/06 148/414
2011/0240180 A1 10/2011 Gao et al.
2012/0241056 A1 9/2012 Sato et al.
2014/0065441 A1 3/2014 Aoshima
2016/0289806 A1 10/2016 Kuwagaki

FOREIGN PATENT DOCUMENTS

| | | |
|---|---|---|
| EP | 2508635 | 10/2012 |
| EP | 2592164 | 5/2013 |
| JP | 2007-107037 | 4/2007 |
| JP | 4255330 | 4/2009 |
| JP | 2010-90408 | 4/2010 |
| JP | 2011-012321 | 1/2011 |
| JP | 2011-231393 | 11/2011 |
| JP | 4830048 | 12/2011 |
| JP | 4885332 | 2/2012 |
| WO | WO 2011/068134 | 6/2011 |
| WO | WO 2013/161351 | 10/2013 |

OTHER PUBLICATIONS

International Search Report corresponding to PCT/JP2013/053681 dated Mar. 19, 2013.
Notification of Transmittal of Translation of the International Preliminary Report on Patentability (Chapter I or Chapter II of the Patent Cooperation Treaty) corresponding to International Patent Application No. PCT/JP2013/053681 dated Nov. 6, 2014.

* cited by examiner

*Primary Examiner* — Roy King
*Assistant Examiner* — Jophy S Koshy
(74) *Attorney, Agent, or Firm* — Jenkins, Wilson, Taylor & Hunt

(57) ABSTRACT

A rolled Cu—Ni—Si based copper alloy having excellent strength, electric conductivity, and bending coefficient is provided. The rolled copper alloy comprises 1.2 to 4.5% by mass Ni, 0.25 to 1.0% by mass Si, and the balance Cu with inevitable impurities. In the direction transverse to the rolling direction, the rolled copper alloy has a bending coefficient of 130 GPa or more and an electrical conductivity of 30% ICAS or more.

3 Claims, No Drawings

CU—NI—SI BASED COPPER ALLOY

RELATED APPLICATIONS

The application is the U.S. National Stage of PCT International Application No. PCT/JP2013/053681, filed on Feb. 15, 2013, which claims priority to Japanese Patent Application No. 2012-098643, filed on Apr. 24, 2012.

FIELD OF THE INVENTION

The present invention relates to a Cu—N—Si based copper alloy suitable for a conductive spring material such as a connector, a terminal, a relay, a switch and the like.

DESCRIPTION OF THE RELATED ART

In the related art, a solute strengthening alloy such as brass and phosphor bronze has been used as a material for a terminal and a connector. Along with a reduction in weight and size of electronic devices, the terminal and the connector are thinned and have reduced sizes. The material used therefor should have high strength and high bendability. In addition, as the connector used in a high temperature condition around an engine room of an automobile, there is needed a material having a good stress relaxation resistance. This is because a stress relaxation phenomenon decreases a connector contact pressure. In view of the above, a Cu—Ni—Si based copper alloy (Corson alloy) having a high strength and a high conductivity provided by precipitation strengthening has been developed (Patent Literature 1).

[Patent Literature 1] International Publication WO 2010/068134 (paragraphs 0004 and 0051, Table 2)

SUMMARY OF THE INVENTION

Problems to be Solved by the Invention

In the meantime, a high bending coefficient is needed for a material used for a connector such that a spring property (elasticity) produces a great load (contact pressure) by a small displacement. However, a Cu—N—Si based copper alloy described in Patent Literature 1 cannot improve the bending coefficient, because the Young's modulus (corresponds to the bending coefficient) is decreased to 110 GPa or less in order to decrease a production cost of the connector. Also, Patent Literature 1 describes that Comparative Example 2-2 (Table 2) where the bending coefficient (the Young's modulus) exceeds 130 GPa has low strength (0.2% bearing force). This may be because total reduction ratio of cold rolling after a solution treatment is as low as 50% or less (Patent Literature 1, paragraph 0051).

The present invention is made to solve the above-described problems. An object thereof is to provide a Cu—Ni—Si based copper alloy having excellent strength, electric conductivity and bending coefficient.

Means for Solving the Problems

Through intense studies by the present inventor about production conditions, it is found that all of strength, electric conductivity and bending coefficient can be successfully improved by increasing an integration degree of a {111} plane that is an orientation for increasing the bending coefficient and by decreasing an integration degree of a {200} plane that is an orientation for decreasing the bending coefficient.

In order to achieve the above-described object, the present invention provides a Cu—Ni—Si based copper alloy, comprising 1.2 to 4.5% by mass of Ni, 0.25 to 1.0% by mass of Si and the balance Cu with inevitable impurities, wherein when an X-ray diffraction intensity of a {111} plane of a rolled surface is represented by I{111} and an X-ray diffraction intensity of a {111} plane of a pure copper powder standard specimen is represented by $I_0\{111\}$, $I\{111\}/I_0\{111\}$ is 0.15 or more, wherein when an X-ray diffraction intensity of a {200} plane of the rolled surface is represented by I{200} and an X-ray diffraction intensity of a plane {200} of the pure copper powder standard specimen is represented by $I_0\{200\}$, $I\{200\}/I_0\{200\}$ is 0.5 or less, when an X-ray diffraction intensity of a {220} plane of the rolled surface is represented by I{220} and an X-ray diffraction intensity of a plane {311} is represented by I{311}, $I\{111\}/(I\{111\}+I\{200\}+I\{220\}+I\{311\})$ is 0.2 or more, a bending coefficient in a direction transverse to rolling direction is 130 GPa or more, a yield strength YS in the direction transverse to rolling direction satisfies: $YS \geq -22\times(\text{Ni mass }\%)^2+215\times(\text{Ni mass }\%)+422$, and the electrical conductivity in the direction transverse to rolling direction is 30% IACS or more.

A crystal grain size is preferably 20 to 100 μm.

In addition, the Cu—Ni—Si based copper alloy preferably further includes a total amount of 0.005 to 2.5% by mass of at least one or more selected from the group consisting of Mg, Mn, Sn, Zn, Co and Cr, or a total amount of 0.005 to 1.0% by mass of at least one or more selected from the group consisting of P, B, Ti, Zr, Al, Fe and Ag.

Effect of the Invention

According to the present invention, a Cu—Ni—Si based copper alloy having excellent strength, electric conductivity and bending coefficient can be provided.

DESCRIPTION OF THE EMBODIMENTS

Hereinafter, a Cu—Ni—Si based copper alloy according to an embodiment of the present invention will be described. The symbol "%" herein refers to % by mass, unless otherwise specified.

(Composition)

[Ni and Si]

In the copper alloy, a Ni concentration is 1.2 to 4.5%, and a Si concentration is 0.25 to 1.0%. Ni forms an intermetallic compound with Si by applying an adequate heat treatment, which improves the strength without degrading the electric conductivity.

If the contents of Ni and Si are less than the above-described ranges, the strength is not well improved. If the contents exceed the above-described ranges, the electric conductivity is lowered and hot workability is lowered.

[Other Additive Elements]

The alloy may further include a total amount of 0.005 to 2.5% by mass of at least one or more selected from the group consisting of Mg, Mn, Sn, Zn, Co and Cr.

Mg improves the strength and a stress relaxation property. Mn improves the strength and the hot workability. Sn improves the strength. Zn improves heat resistance at a solder joint. As Co and Cr form a compound with Si, similar to Ni, the strength is improved without degrading the electric conductivity by precipitation hardening.

In addition, the alloy may further include a total amount of 0.005 to 1.0% by mass of at least one or more selected from the group consisting of P, B, Ti, Zr, Al, Fe and Ag.

These elements included improve the electric conductivity, the strength, the stress relaxation property and product properties such as plating.

If the total amount of the above-described elements is less than the above-described range, the above-described advantages are not provided. If the total amount exceeds the above-described range, the electric conductivity may be lowered.

[X-Ray Diffraction Intensity]

When an X-ray diffraction intensity of a {111} plane of a rolled surface is represented by I{111} and an X-ray diffraction intensity of a {111} plane of a pure copper powder standard specimen is represented by $I_0${111}, I{111}/$I_0${111} is 0.15 or more. When an X-ray diffraction intensity of a {200} plane of the rolled surface is represented by I{200} and an X-ray diffraction intensity of a {200} plane of the pure copper powder standard specimen is represented by $I_0${200}, I{200}/$I_0${200} is 0.5 or less. When an X-ray diffraction intensity of a {220} plane of the rolled surface is represented by I{220} and an X-ray diffraction intensity of a {311} plane is represented by I{311}, I{111}/(I{111}+I{200}+I{220}+I{311}) is 0.2 or more.

I{111}/$I_0${111} reflects an integration degree of the {111} plane. I{200}/$I_0${200} reflects an integration degree of the {200} plane. If I{111}/$I_0${111} is less than 0.15, the {111} plane that is an orientation where the bending coefficient is improved has a low integration degree. If I{200}/$I_0${200} exceeds 0.5, the {200} plane that is an orientation where the bending coefficient is lowered has a high integration degree such that the bending coefficient is not improved.

If I{111}/(I{111}+I{200}+I{220}+I{311}) is less than 0.2, the {111} plane that is an orientation where the bending coefficient is improved has a low integration degree such that the bending coefficient is not improved. (I{111}+I{200}+I{220}+I{311}) is a main orientation of the rolled surface. I{111}/(I{111}+I{200}+I{220}+I{311}) roughly reflects the integration degree of the {111} plane.

[Bending Coefficient, Strength and Electric Conductivity]

The bending coefficient in a direction transverse to rolling direction is 130 GPa or more. A yield strength YS in the direction transverse to rolling direction satisfies: $YS \geq -22 \times (\text{Ni mass } \%)^2 + 215 \times (\text{Ni mass } \%) + 422$. The electrical conductivity in the direction transverse to rolling direction is 30% IACS or more.

The bending coefficient is measured in accordance with the technical standard of Japan Copper and Brass Association (JCBAT312:2002). The yield strength YS is measured in accordance with JIS-Z2241. The electrical conductivity (% IACS) is measured in accordance with JIS-H0505 by a four-terminal method. Note that there is the Young's modulus as an indicator similar to the bending coefficient. While the Young's modulus is provided by a tensile test, the bending coefficient is calculated from a deflection amount provided by applying a load to a cantilever within an elastic limit. Accordingly, it appears that the bending coefficient reflects the contact pressure at a contact part of a connector spring much better. That is why the bending coefficient is used in the present invention.

[Crystal Grain Size]

A crystal grain size of the alloy is preferably 20 to 100 μm. If the crystal grain size is less than 20 μm, the integration degree of the {111} plane is not increased so that the bending coefficient may not be improved. If the crystal grain size exceeds 100 μm, the grain size is coarsened so that the intensity may be decreased.

The crystal grain size is measured in accordance with JIS-H0501, cutting method.

In general, the Cu—Ni—Si based copper alloy of the present invention can be produced by hot rolling an ingot and mechanical finishing, a first cold rolling, recrystallization annealing, a second cold rolling, a solution treatment, a third cold rolling, an aging treatment and a final cold rolling. After the final cold rolling, stress relief annealing may be performed.

The recrystallization annealing is performed at 650° C. or more. If a temperature of the recrystallization annealing is less than 650° C., the integration degree of the {111} plane is not increased so that the bending coefficient may not be improved. The higher the temperature of the recrystallization annealing is, the better. However, if it exceeds 800° C., the effect that the integration degree of the {111} plane is increased is saturated, which leads to increased costs. Thus, 800° C. or less is preferable.

The second cold rolling is performed at a reduction ratio of greater than 50%. If the reduction ratio is less than 50%, the integration degree of the {111} plane is not increased and the integration degree of the {200} plane is increased, thereby not improving the bending coefficient.

The solution treatment is performed at 800 to 1000° C. If the temperature of the solution treatment is less than 800° C., Ni and Si are not sufficiently dissolved and the crystal grain size is less than 20 μm. If the temperature of the solution treatment exceeds 1000° C., the crystal grain size exceeds 100 μm.

The third cold rolling is not performed (0%) or performed at the reduction ratio of 50% or less. If the reduction ratio is greater than 50%, the effect that the bending coefficient and the strength are improved is saturated.

The aging treatment is performed at 400 to 550° C.

The final cold rolling is performed at the reduction ratio of 30 to 80%. If the reduction ratio is less than 30%, the strength is decreased. If the reduction ratio is greater than 80%, the effect that the bending coefficient and the strength are improved is saturated.

The cold rollings (the third cold rolling and the final cold rolling) after the solution treatment are performed at total reduction ratio of greater than 50%. If the total reduction ratios is 50% or less, the integration degree of the {111} plane is not increased and the bending coefficient and the strength are not improved.

The recrystallization annealing improves the bending coefficient. When the third cold rolling and the final cold rolling are performed at a total reduction ratio of greater than 50%, i.e., to a high reduction ratio, both of the bending coefficient and the strength are improved.

EXAMPLES

Electrolytic copper was melted in an atmosphere melting furnace. A predetermined amount of additive elements shown in Table 1 were added thereto to agitate a molten metal. Thereafter, the molten metal was poured into a mold at a pouring temperature of 1100° C. to provide each copper alloy ingot having a composition shown in Table 1. The ingot was mechanical finished and then subjected to the hot rolling, the first cold rolling, the recrystallization annealing, the second cold rolling, the solution treatment, the third cold rolling, the aging treatment and the final cold rolling to provide each specimen having a thickness of 0.2 mm. After the final cold rolling, the stress relief annealing was performed (400° C.×30 sec).

The hot rolling was performed after heating at 1000° C. for 3 hours, and the aging treatment was performed at 400° C. to 550° C. for 1 to 15 hours. The conditions of the recrystallization annealing, the second cold rolling and the solution treatment as well as the cold rollings after the solution treatment (the third cold rolling and final cold rolling) are shown in Table 1.

<Evaluation>

Each resultant specimen was evaluated for the following items.

[Average Crystal Grain Size]

Each specimen having a width of 20 mm×a length of 20 mm was subjected to electrolytic polishing after the solution treatment. A backscattered electron image thereof was captured by FE-SEM manufactured by Philips Co., Ltd. with ×500 magnification. For images of 5 field of view, the crystal grain size was measured in accordance with JIS-H0501, the cutting method, to calculate an average value.

[X-Ray Diffraction Intensity]

An X-ray diffractometer (RINT2500 manufactured by Rigaku Corporation) was used to perform a standard measurement for each specimen. Using an attached software, an integral intensity of the X-ray diffraction intensity was calculated over the {111} plane, the {200} plane, the {220} plane and the {311} plane of the rolled surface. The similar measurement was performed on pure copper powder standard specimen (325 mesh) to measure the X-ray diffraction intensity from each plane. X-rays were irradiated by using a Cu target at a tube voltage of 25 kV and a tube current of 20 mA.

[Bending Coefficient and Yield Strength]

A tensile test was performed for each specimen in a direction transverse to rolling direction, and the yield strength YS was determined in accordance with JISZ2241. The bending coefficient was measured in accordance with Japan Copper and Brass Association (JCBAT312:2002).

[Electrical Conductivity]

A resistivity of each specimen was measured by a four-terminal method using a double bridge apparatus in accordance with JIS-H0505 to calculate the electrical conductivity (% IAC).

Tables 1 and 2 show the results obtained.

TABLE 1

| | Composition(mass %) | | | Recrystallization annealing temperature | Second cold rolling reduction | Solution treatment | | Total reduction ratio of cold rollings after solution treatment(%) |
|---|---|---|---|---|---|---|---|---|
| No | Ni | Si | Others | (° C.) | ratio (%) | Temperature (° C.) | Crystal grain size (μm) | |
| Example 1 | 1.5 | 0.34 | 0.5Zn, 0.5Sn | 750 | 60 | 800 | 60 | 60 |
| Example 2 | 2.3 | 0.50 | | 750 | 60 | 800 | 30 | 60 |
| Example 3 | 2.3 | 0.50 | 0.1Mg | 750 | 60 | 800 | 30 | 60 |
| Example 4 | 2.3 | 0.50 | 0.1Mg, 1.0Zn, 0.5Sn | 750 | 60 | 800 | 30 | 60 |
| Example 5 | 2.8 | 0.64 | 0.5Sn, 0.5Zn | 750 | 60 | 850 | 30 | 60 |
| Example 6 | 2.8 | 0.64 | 0.1Mg | 750 | 60 | 850 | 30 | 60 |
| Example 7 | 3.8 | 0.80 | | 750 | 60 | 900 | 30 | 60 |
| Example 8 | 3.8 | 0.80 | 0.1Mg, 0.1Mn | 750 | 60 | 900 | 30 | 60 |
| Example 9 | 3.8 | 0.80 | 0.05Cr, 0.1Mg, 0.1Mn | 750 | 60 | 900 | 30 | 60 |
| Example 10 | 4.4 | 1.00 | | 750 | 60 | 950 | 30 | 60 |
| Example 11 | 2.0 | 0.70 | 1.0Co, 0.1Cr | 750 | 60 | 950 | 30 | 60 |
| Example 12 | 2.3 | 0.50 | 0.01P, 0.01B, 0.01Ti, 0.01Zr, 0.01Al, 0.02Fe, 0.5Ag | 750 | 60 | 850 | 30 | 60 |
| Example 13 | 3.8 | 0.80 | 0.1Mg, 0.1Mn | 650 | 60 | 900 | 30 | 60 |
| Example 14 | 3.8 | 0.80 | 0.1Mg, 0.1Mn | 750 | 80 | 900 | 30 | 60 |
| Example 15 | 3.8 | 0.80 | 0.1Mg, 0.1Mn | 750 | 55 | 950 | 50 | 65 |
| Example 16 | 3.8 | 0.80 | 0.1Mg, 0.1Mn | 750 | 60 | 850 | 20 | 60 |
| Example 17 | 3.8 | 0.80 | 0.1Mg, 0.1Mn | 750 | 60 | 950 | 50 | 60 |
| Example 18 | 3.8 | 0.80 | 0.1Mg, 0.1Mn | 750 | 60 | 980 | 90 | 60 |
| Example 19 | 3.8 | 0.80 | 0.1Mg, 0.1Mn | 750 | 60 | 950 | 50 | 70 |
| Example 20 | 3.8 | 0.80 | 0.1Mg, 0.1Mn | 750 | 60 | 950 | 50 | 55 |
| Comparative Example 1 | 2.3 | 0.20 | | 750 | 60 | 800 | 30 | 60 |
| Comparative Example 2 | 3.8 | 1.20 | | 750 | 60 | 900 | 30 | 60 |
| Comparative Example 3 | 1.1 | 0.26 | | 750 | 60 | 800 | 50 | 60 |
| Comparative Example 4 | 4.7 | 1.00 | | Cancel because of cracks generated in hot rollng | | | | |
| Comparative Example 5 | 3.8 | 0.80 | 0.5Mg, 1.0Mn, 1.2Zn | 750 | 60 | 950 | 50 | 60 |
| Comparative Example 6 | 3.8 | 0.80 | 0.5Sn, 0.5Cr, 1.0Co, 0.2Mg | 750 | 60 | 950 | 30 | 60 |
| Comparative Example 7 | 3.8 | 0.80 | 0.5Fe, 0.1P, 0.5Ti | 750 | 60 | 950 | 50 | 60 |
| Comparative Example 8 | 3.8 | 0.80 | 0.1Mg, 0.1Mn | 600 | 60 | 900 | 30 | 60 |
| Comparative Example 9 | 3.8 | 0.80 | 0.1Mg, 0.1Mn | 750 | 40 | 900 | 30 | 60 |
| Comparative Example 10 | 3.8 | 0.80 | 0.1Mg, 0.1Mn | 750 | 60 | 750 | 15 | 60 |
| Comparative Example 11 | 3.8 | 0.80 | 0.1Mg, 0.1Mn | 750 | 60 | 1050 | 110 | 60 |
| Comparative Example 12 | 3.8 | 0.80 | 0.1Mg, 0.1Mn | 750 | 60 | 900 | 30 | 40 |

TABLE 1-continued

| No | Composition(mass %) Ni | Si | Others | Recrystallization annealing temperature (° C.) | Second cold rolling reduction ratio (%) | Solution treatment Temperature (° C.) | Solution treatment Crystal grain size (μm) | Total reduction ratio of cold rollings after solution treatment(%) |
|---|---|---|---|---|---|---|---|---|
| Comparative Example 13 | 3.8 | 0.80 | 0.1Mg, 0.1Mn | 600 | 30 | 750 | 15 | 30 |
| Comparative Example 14 | 3.8 | 0.80 | 0.1Mg, 0.1Mn | — | — | 900 | 30 | 60 |

TABLE 2

| No | I{111}/ $I_0$\{111} | I{200}/ $I_0$\{200} | I{111}/ (I{111} + I{200} + I{200} + {311} | Yield strengh YS(MPa) | Electrical conductivity (% IACS) | Bending coefficient (GPa) |
|---|---|---|---|---|---|---|
| Example 1 | 0.25 | 0.48 | 0.23 | 730 | 44 | 133 |
| Example 2 | 0.55 | 0.30 | 0.42 | 820 | 48 | 137 |
| Example 3 | 0.60 | 0.34 | 0.43 | 850 | 45 | 138 |
| Example 4 | 0.50 | 0.43 | 0.38 | 870 | 42 | 136 |
| Example 5 | 0.58 | 0.38 | 0.42 | 910 | 43 | 136 |
| Example 6 | 0.65 | 0.23 | 0.47 | 920 | 39 | 139 |
| Example 7 | 0.60 | 0.25 | 0.45 | 950 | 38 | 137 |
| Example 8 | 0.69 | 0.11 | 0.51 | 1000 | 36 | 139 |
| Example 9 | 0.75 | 0.16 | 0.52 | 1010 | 36 | 138 |
| Example 10 | 0.88 | 0.13 | 0.56 | 1030 | 33 | 141 |
| Example 11 | 0.35 | 0.46 | 0.29 | 920 | 44 | 134 |
| Example 12 | 0.41 | 0.45 | 0.33 | 850 | 42 | 135 |
| Example 13 | 0.50 | 0.47 | 0.37 | 990 | 35 | 133 |
| Example 14 | 0.80 | 0.07 | 0.55 | 1005 | 35 | 141 |
| Example 15 | 0.58 | 0.39 | 0.42 | 1015 | 34 | 137 |
| Example 16 | 0.40 | 0.49 | 0.32 | 995 | 35 | 132 |
| Example 17 | 0.82 | 0.296 | 0.52 | 1000 | 34 | 140 |
| Example 18 | 0.70 | 0.11 | 0.51 | 960 | 34 | 139 |
| Example 19 | 0.91 | 0.12 | 0.57 | 1005 | 33 | 143 |
| Example 20 | 0.70 | 0.16 | 0.50 | 995 | 35 | 138 |
| Comparative Example 1 | 0.24 | 0.88 | 0.19 | 530 | 27 | 136 |
| Comparative Example 2 | 0.58 | 0.39 | 0.42 | 950 | 26 | 137 |
| Comparative Example 3 | 0.26 | 0.80 | 0.21 | 570 | 50 | 134 |
| Comparative Example 4 | Cancel because of cracks generated in hot rollng | | | | | |
| Comparative Example 5 | 0.75 | 0.13 | 0.52 | 970 | 24 | 136 |
| Comparative Example 6 | 0.76 | 0.15 | 0.52 | 990 | 25 | 136 |
| Comparative Example 7 | 0.80 | 0.10 | 0.54 | 910 | 27 | 135 |
| Comparative Example 8 | 0.08 | 0.66 | 0.08 | 990 | 33 | 120 |
| Comparative Example 9 | 0.11 | 0.57 | 0.11 | 970 | 34 | 122 |
| Comparative Example 10 | 0.13 | 0.52 | 0.13 | 850 | 44 | 123 |
| Comparative Example 11 | 0.50 | 0.47 | 0.37 | 860 | 34 | 134 |
| Comparative Example 12 | 0.13 | 0.55 | 0.13 | 910 | 35 | 127 |
| Comparative Example 13 | 0.06 | 0.68 | 0.05 | 820 | 45 | 118 |
| Comparative Example 14 | 0.12 | 0.26 | 0.14 | 990 | 34 | 125 |

As apparent from Tables 1 and 2, in each Example where $I\{111\}/I_0\{111\}$ is 0.15 or more, $I\{200\}/I_0\{200\}$ is 0.5 or less and $I\{111\}/(I\{111\}+I\{200\}+I\{220\}+I\{311\})$ is 0.2 or more, the bending coefficient in a direction transverse to rolling direction was 130 GPa or more, the yield strength YS in the direction transverse to rolling direction satisfied: $YS \geq -22\times(\text{Ni mass }\%)^2+215\times(\text{Ni mass }\%)+422$, and the electrical conductivity in the direction transverse to rolling direction was 30% IACS or more.

On the other hand, in Comparative Example 3 where Ni was less than 1.2% and in Comparative Example 1 where Si is less than 0.25%, as the yield strength YS in the direction transverse to rolling direction did not satisfied: $YS \geq -22\times(\text{Ni mass }\%)^2+215\times(\text{Ni mass }\%)+422$, the yield strength YS was decreased.

In Comparative Example 2 where Si exceeded 1.0%, the electrical conductivity was undesirably less than 30% IACS.

In Comparative Example 4 where Ni exceeded 4.5%, cracks were generated in the hot rolling and the alloy could not be produced.

In Comparative Examples 5 and 6 where a total amount of Mg, Mn, Sn, Zn, Co and Cr exceeded 2.5% and in Comparative Example 7 where a total amount of P, B, Ti, Zr, Al, Fe and Ag exceeded 1.0%, the electrical conductivity was undesirably less than 30% IACS.

In Comparative Example 8 where the temperature of the recrystallization annealing was less than 650° C. and in Comparative Example 9 where the reduction ratio of the second cold rolling was less than 50%, the integration degree of the {111} plane was not increased and the bending coefficient in a direction transverse to rolling direction was undesirably less than 130 GPa.

In Comparative Example 10 where the temperature of the solution treatment was less than 800° C., Ni and Si were not fully dissolved and the yield strength YS in the direction transverse to rolling direction did not satisfied: $YS \geq -22\times(\text{Ni mass }\%)^2+215\times(\text{Ni mass }\%)+422$ such that the yield strength YS was decreased. In addition, the crystal grain size was less than 20 μm, the integration degree of the {111} plane was not increased and the bending coefficient in a direction transverse to rolling direction was undesirably less than 130 GPa.

In Comparative Example 11 where the temperature of the solution treatment exceeded 1000° C., as the yield strength YS in the direction transverse to rolling direction did not satisfied: $YS \geq -22\times(\text{Ni mass }\%)^2+215\times(\text{Ni mass }\%)+422$, the yield strength YS was decreased.

In Comparative Examples 12 and 13 where the total reduction ratio of the cold rollings after the solution treatment was 50% or less, the integration degree of the {111} plane was not increased and the bending coefficient in a direction transverse to rolling direction was undesirably less than 130 GPa. In addition, the yield strength YS in the direction transverse to rolling direction did not satisfied: $YS \geq -22\times(\text{Ni mass }\%)^2+215\times(\text{Ni mass }\%)+422$ such that the yield strength YS was decreased.

In Comparative Example 14 where the recrystallization annealing and the second cold rolling were not performed, the integration degree of the {111} plane was not increased and the bending coefficient in a direction transverse to rolling direction was undesirably less than 130 GPa.

What is claimed is:

1. A rolled Cu—Ni—Si based copper alloy, comprising 1.2 to 4.5% by mass of Ni and 0.25 to 1.0% by mass of Si, wherein $I\{111\}/I_0\{111\}$ is 0.15 or more, $I\{200\}/I_0\{200\}$ is 0.5 or less, and $I\{111\}/(I\{111\}+I\{200\}+I\{220\}+I\{311\})$ is 0.2 or more, wherein I{111} is a X-ray diffraction intensity of a {111} plane of a rolled surface of the rolled Cu—Ni—Si based copper alloy, $I_0\{111\}$ is a X-ray diffraction intensity of a {111} plane of a pure copper powder standard specimen, I{200} is a X-ray diffraction intensity of a {200} plane of a rolled surface of the rolled Cu—Ni—Si based copper alloy, $I_0\{200\}$ is a X-ray diffraction intensity of a plane {200} of the pure copper powder standard specimen, I{220} is a X-ray diffraction intensity of a {220} plane of a rolled surface of the rolled Cu—Ni—Si based copper alloy, and I{311} is a X-ray diffraction intensity of a plane {311} of a rolled surface of the rolled Cu—Ni—Si based copper alloy, a bending coefficient in a direction transverse to rolling direction is 130 GPa or more, a yield strength in MPa, YS (MPa), in the direction transverse to rolling direction satisfies: $YS\ (\text{MPa}) \geq [-22\times(\text{MPa}/(\text{mass }\%)^2)\times(\text{Ni mass }\%)^2]+[215\times(\text{MPa}/(\text{mass }\%))\times(\text{Ni mass }\%)]+422\ (\text{MPa})$, and the electrical conductivity in the direction transverse to rolling direction is 30% IACS or more.

2. The rolled Cu—Ni—Si based copper alloy according to claim 1, further comprising one or more elements selected from the group consisting of Mg, Mn, Sn, Zn, Co and Cr, wherein the sum of Mg, Mn, Sn, Zn, Co and Cr is 0.005 to 2.5 mass % of the alloy.

3. The rolled Cu—Ni—Si based copper alloy according to claim 1, further comprising one or more elements selected from the group consisting of P, B, Ti, Zr, Al, Fe and Ag, wherein the sum of P, B, Ti, Zr, Al, Fe, and Ag is 0.005 to 1.0 mass % of the alloy.

* * * * *